US011098985B2

(12) United States Patent
Kadavanich et al.

(10) Patent No.: US 11,098,985 B2
(45) Date of Patent: Aug. 24, 2021

(54) DECOY

(71) Applicant: Rheinmetall Waffe Munition GmbH, Unterlüß (DE)

(72) Inventors: Vikorn Kadavanich, Bayerisch Gmain (DE); Florian Huber, Anger (DE)

(73) Assignee: RHEINMETALL WAFFE MUNITION GMBH, Unterlüß (DE)

( * ) Notice: Subject to any disclaimer, the term of this patent is extended or adjusted under 35 U.S.C. 154(b) by 0 days.

(21) Appl. No.: 16/754,871

(22) PCT Filed: Sep. 17, 2018

(86) PCT No.: PCT/EP2018/075023
§ 371 (c)(1),
(2) Date: Apr. 9, 2020

(87) PCT Pub. No.: WO2019/076555
PCT Pub. Date: Apr. 25, 2019

(65) Prior Publication Data

US 2020/0309489 A1 Oct. 1, 2020

(30) Foreign Application Priority Data

Oct. 18, 2017 (DE) ..... 10 2017 124 351.8

(51) Int. Cl.
*F41H 11/02* (2006.01)
*F42B 12/70* (2006.01)

(52) U.S. Cl.
CPC ..... *F41H 11/02* (2013.01); *F42B 12/70* (2013.01)

(58) Field of Classification Search
CPC ..... F41H 11/02; F41H 11/32; F42B 12/70
(Continued)

(56) References Cited

U.S. PATENT DOCUMENTS 2,986,091 A * 5/1961 Ferguson ..... F42B 8/16 102/529
3,138,102 A * 6/1964 Meyer ..... F42B 7/10 102/509

(Continued)

FOREIGN PATENT DOCUMENTS

EP 0775886 A1 5/1997
EP 2671799 A1 12/2013

OTHER PUBLICATIONS

International Search Report from corresponding PCT Application No. PCT/EP2018/075023, dated Dec. 17, 2018.

*Primary Examiner* — Bret Hayes
(74) *Attorney, Agent, or Firm* — Harness, Dickey & Pierce, P.L.C.

(57) ABSTRACT

The invention relates to a decoy (3) for protecting a fast aircraft (1) against an incoming threat (2), wherein said decoy is non-driven. The decoy (3) has a squib (6) on one end and a molded body (11) on the opening side. If the decoy (3) has an active material container (8), the squib (6) can be attached to the end side thereof and the molded body (11) attached to the opening side thereof. The squib (6) contains a propellant, which is converted into a drive energy. The molded body (11) is heavier than the decoy (3) without the molded body (11) and has the task of preventing the separating of the molded body (3) to the rear. In addition, the molded body (11) should be at least 1.0-1.5 times heavier than the decoy itself. Advantageously, however, the molded body (11) is twice as heavy.

10 Claims, 2 Drawing Sheets

(58) Field of Classification Search
USPC ..... 102/504, 505; 89/1.51, 1.54, 1.57
See application file for complete search history.

(56) References Cited

U.S. PATENT DOCUMENTS

| | | | | | |
|---|---|---|---|---|---|
| 4,295,425 | A * | 10/1981 | Davis | F42B 15/00 | 102/376 |
| 5,561,260 | A * | 10/1996 | Towning | C06B 27/00 | 102/336 |
| 5,585,594 | A * | 12/1996 | Pelham | C06B 27/00 | 102/336 |
| 6,429,800 | B1 | 8/2002 | Richmond | | |
| 6,666,143 | B1 * | 12/2003 | Collins | F42B 5/15 | 102/334 |
| 7,341,002 | B1 * | 3/2008 | Baker | F42B 12/36 | 102/336 |
| 7,916,065 | B1 * | 3/2011 | Mintz | F41H 11/02 | 342/13 |
| 2004/0011235 | A1 * | 1/2004 | Callaway | F42B 12/70 | 102/336 |
| 2005/0001755 | A1 | 1/2005 | Steadman et al. | | |
| 2019/0178613 | A1 * | 6/2019 | Zaetterqvist | B64D 7/00 | |

* cited by examiner

DECOY

CROSS REFERENCE TO RELATED APPLICATIONS

This application is a national phase entry of PCT/EP2018/075023, filed on 17 Sep. 2018, which claims priority to and the benefit of German Patent Application No. 10 2017 124 351.8, filed on 18 Oct. 2017, the entire contents of which are incorporated herein by references.

FIELD

The invention deals with a decoy for the formation of a dummy target for the protection of an object, for example, an aircraft. The invention relates in particular to a kinematic dummy target for fast-flying aircraft to protect against IR threats.

BACKGROUND

An HF dummy target as well as a method for deceiving radar-based missiles are known from WO 2008/050343 A2. The self-contained airborne HF dummy targets are set up to protect against multiple radar-based enemy threats. The HF dummy target includes means for receiving multiple radar signals from one or more directions, means for storing the radar signals as well as means for analyzing the radar signals to determine threat parameters, etc. Depending on the type of threat, the HF dummy target is ejected backwards, downwards or forwards.

For threats that lock on to heat sources, the search heads are usually met with IR dummy targets. The purpose of this measure is that the search head sees the dummy target as a more lucrative target and selects this dummy target, and then attacks it. An active pyrotechnic body of this type is described inter alia by U.S. Pat. No. 6,427,599 B1.

An active material container for an active material block is known from DE 10 2008 017 722 A1. This has an inflow protection in the form of a cap with an integrated protection, support, guidance or positioning function.

DE 10 2008 017 725 A1 reveals a safety device for an active material block forming a dummy target, which is inserted in an active material container with a sabot as well as an ignition transfer charge. The safety device is characterized by a pre-tensioned tube sensor, which is integrated between the sabot, the ignition transfer charge and the active material container. The tube sensor closes an ignition channel between the ignition transfer charge and the active material and releases this channel after leaving a launch tube. Following a release, the tube sensor can also interrupt the ignition chain again.

Modern search heads are able to distinguish a dummy target from a real target. These search heads are specifically able to recognize whether it is a defensive measure, i.e. a dummy target, or the target itself. These search heads evaluate the departure of the dummy target away from the target. In this way, such search heads can learn that heat sources that are ejected from the target, i.e. opposite to the direction of flight of the target, are a dummy target. These search heads can detect and filter out a false target via the so-called "sightline rotation rate".

In order to successfully defend against such threats, it is therefore necessary to eject the active body or the dummy target in such a way that the search head cannot detect the dummy target as a dummy target. It must be avoided that the search head does not lock on to the actual target again. In such cases, the dummy target must be deployed or ejected in the direction of flight and in front of the target. A rapid separation of the dummy target and the target must be carried out in doing so.

Non-powered dummy targets are used in particular for slow-flying aircraft, such as helicopters and transport aircraft. Slow-flying aircraft usually have a flight speed of less than 300 knots.

For fast-flying aircraft, such as jets with speeds of 300 to 600 knots, driven dummy targets are currently used to achieve the necessary separation behavior of the aircraft and the dummy target. The driven dummy target must overtake the fast-flying aircraft in such a way that the search head defines this dummy target as the actual target. Rocket propulsion is usually used as a propulsion system. The disadvantage of this drive concept is that they are complex, expensive and require their own installation space. This is also at the expense of the amount of the mass of the dummy target. There are currently no plans to use non-powered dummy targets as a dummy target for a fast-flying aircraft. This is based on the assumption that non-powered dummy targets cannot provide the speed to exceed the fast-flying aircraft's own speed. This assumption also results from the fact that the inflow velocity to the dummy target separates it rearwards too quickly, i.e. in the direction that the search head of the dummy target also recognizes as a dummy target.

SUMMARY

Here the object of the invention becomes to reveal a dummy target or an active body or a decoy for fast-flying aircraft that can manage with non-powered dummy targets, so that expensive rocket propulsion can be dispensed with.

The object is achieved by the features of claim 1. Advantageous embodiments are revealed in the subordinate claims.

The setting of the $V_o$ speed is limited and subject to technical specifications, due to the maximum permissible recoil forces for the launcher system. There are therefore limits in this area.

The invention is therefore based on the idea of designing the decoy forming the dummy target in such a way that it limits the recoil peaks when the decoy is ejected from a launcher or the like. Rather, the decoy and thus the dummy target is subjected to an impulse input in order to position itself as quickly in front of the object to be protected and to be able to separate itself therefrom.

This idea is implemented by attaching an additional molded body to the front end of the decoy when viewed in the direction of flight. The igniter and the molded body are to be matched to each other in order to precisely adjust a recoil and to achieve an adequate $V_o$. The weight of the molded body prevents premature separation of the decoy and the aircraft to the rear. The decoy opposes the inflow speed with this weight.

The aim of this simple design is that this molded body of the decoy can separate itself sufficiently quickly and safely from the aircraft. By selecting the molded body in coordination with the igniter, the decoy overtakes the aircraft in order to form a better target for the incoming threat without detection as a dummy target. The decoy and thus the dummy target are given an excessive impulse during ejection, which then decreases over the necessary period of time. The principle is based on a forward separation of and leading by a non-driven decoy relative to the aircraft to be protected immediately after ejection.

By eliminating rocket propulsion systems, much more active material can be introduced into the dummy target, so that the dummy target can work for a sufficiently long time. The separation of the decoy from the target or aircraft takes place at an angle to the target in order to be able to position itself better relative to the threat and to prevent the search head from returning to the actual target. The decoy or the dummy target constructed in this way thus fulfils all the prerequisites for preventing the search body from jumping back to the actual target.

In the igniter, propellant powder is proposed, a fuel whose chemical energy is converted into a kind of driving force by combustion. Black powder, on the other hand, should be avoided in order to limit the associated recoil peaks in the launcher systems and to accelerate the decoy sufficiently.

As already stated, the material for the molded body should be heavy, i.e. have a heavy weight or a heavy mass. It should be heavier than the decoy itself, i.e. without a molded body. This includes a molded body made of tungsten among other things. Although gold and other materials would also meet this condition, the associated costs must be taken into account. As a dummy target active material, MTV (Magnesium/Teflon/Viton) can be used in a known way.

A decoy is proposed to protect a so-called fast-flying aircraft against an incoming threat that is not powered. The decoy has an igniter at the end and a molded body on the muzzle side. If the decoy has an active material container, the igniter can be attached to it at the end and the molded body can be attached to it on the muzzle side. The igniter contains a propellant charge, which is converted into propulsion energy and gives the decoy the necessary power (energy) to set off from the fast-flying aircraft forwards, i.e. to separate. The molded body is heavier than the decoy itself (without the molded body) and has the task of slowing down the separation of the decoy rearwards. For this purpose, the molded body should be at least 1.0-1.5 times heavier than the decoy. Advantageously, the molded body is at least twice as heavy.

BRIEF DESCRIPTION OF THE DRAWINGS

The invention will be explained in more detail based on an exemplary embodiment with a drawing. In the figures.

DETAILED DESCRIPTION

Figure 1:
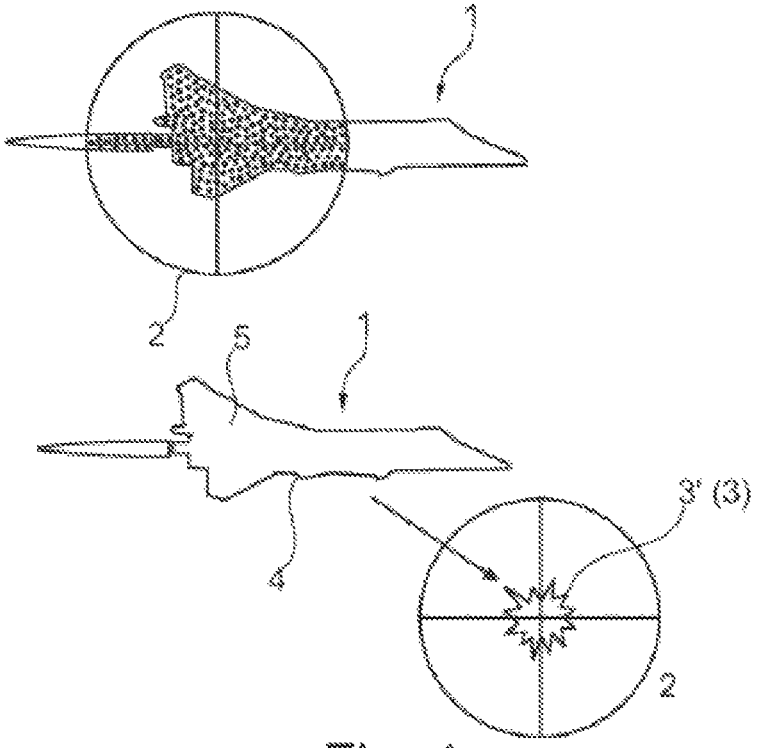
FIG. 1 shows a schematic representation of a typical deployment scenario of an aircraft with a dummy target.

A fast-flying aircraft (fast flyer) 1 is shown in FIG. 1. This representation in FIG. 1 shows the view from a threat 2, in this case the view from a search head.

To ward off this threat, after detection a decoy 3 is deployed against the threat to simulate a dummy target 3'. For this purpose, the fast-flying aircraft 1 has at least one launcher 4, which is designed to be able to eject the decoy 3 forwards in the direction of flight of the fast flyer 1. At least one warning sensor 5 is envisaged as a detection sensor, which detects the incoming threat 2 and activates the launcher 4 or the protection system, which counters the threat 2 with the decoy 3. Due to the property of this decoy 3 and the mode of action of the threat 2, the threat 2 perceives this decoy 3 as a more attractive target and switches to this dummy target 3'. The decoy 3 is deployed forwards relative to the aircraft at an angle, preferably in a solid angle to the fast-flying aircraft 1 (FIG. 1).

Figure 2:
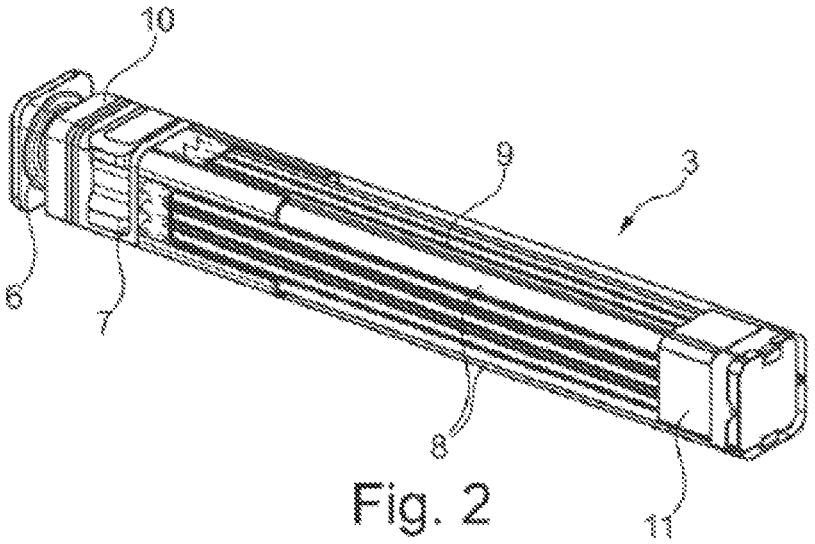
FIG. 2 shows a slightly transparent representation of the dummy target before firing with the essential components.
Figure 3:
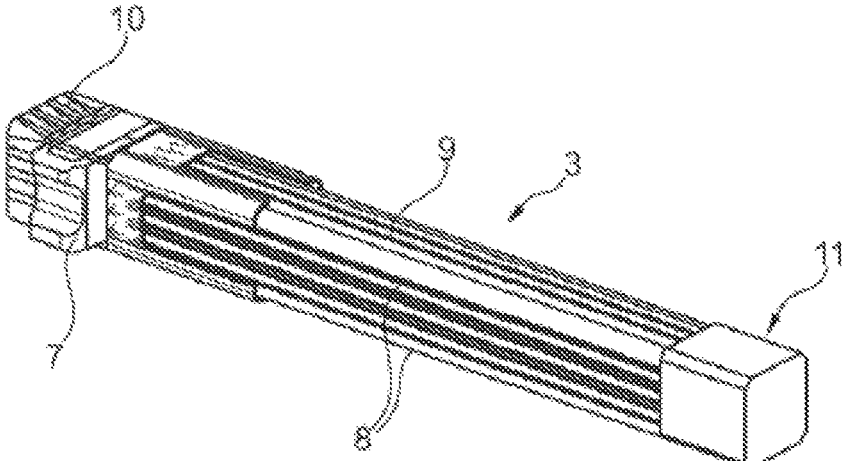
FIG. 3 shows a representation of the dummy target from FIG. 2 after firing.

The structure of the decoy 3 is shown by FIGS. 2 and 3.

The decoy 3 comprises an igniter 6, which is attached at the end to an active material container 8 of the decoy 3. For safety reasons, a tube sensor 7 is provided between a sabot 10 and the igniter 6. The active material container 8 is used in turn to accommodate an active material 9.

At the front or on the muzzle side, a molded body 11 is integrated on the active material container 8. The molded body 11 attached to the active material container 8 on the muzzle side is of a solid construction. The weight of the molded body 11 is greater than the weight of the decoy 3 without the molded body 11. As a rule, the molded body 11 for fast-flying aircraft should be at least 1.0-1.5 times what the decoy 3 would weigh without molded body 11. In practice, it has been shown to be sufficient if the molded body 11 is twice as heavy as the decoy 3 itself without the molded body 11. The molded body 11 can preferably consist of tungsten.

The molded body 11 and the igniter 6 or the propellant contained therein are coordinated with each other in such a way that the expected recoil is precisely adjusted.

FIG. 3 shows the decoy 3 shortly after ejection from a launch tube of the launcher 4 that is not shown in detail. With the ignition of an ignition charge (propellant) in the igniter 6, the decoy 3 receives a power input, i.e. a driving force that not only drives it out of the launch tube of the launcher 4, but counteracts a recoil pulse that usually occurs during launch and thus does not allow it to arise. The decoy 3 acted upon by this surplus impulse moves in front of the fast-flying aircraft 1 as a result of the impulse, wherein in this phase the decoy 3 becomes a dummy target 3'. For this purpose, the tube sensor 7 releases the ignition channel, which is not shown in detail, wherein the active material 9 is ignited and the dummy target 3' forms.

The expansion of the dummy target 3' is perceived by the threat 2 as a target, as it is set up in the direction of the fast-flying aircraft 1. The active material 9, in turn, lights up for so long that the threat 2 can no longer lock on to the fast-flying aircraft 1 when it flies past the dummy target 3'.

What is claimed is:

1. A decoy for protection of a fast flyer against an incoming threat and formation of a dummy target, wherein an igniter is attached to an end of the decoy and a molded body is attached to a muzzle side of the decoy, wherein the molded body is heavier than the decoy without the molded body, wherein the igniter contains a propellant charge, wherein the decoy is not driven after ejection.

2. The decoy as claimed in claim 1, wherein the molded body is greater than 1.0 times heavier than the decoy and up to at least 1.5 times heavier than the decoy.

3. The decoy as claimed in claim 1, wherein the molded body is twice as heavy as the decoy.

4. The decoy as claimed in claim 1, wherein the molded body consists of tungsten or gold.

5. The decoy according to claim 1, wherein MTV is used as a dummy target active material.

6. A fast flyer with a decoy as claimed in claim 1.

7. The fast flyer as claimed in claim 6, characterized by a launcher for ejecting at least one decoy and at least one warning sensor for detecting an incoming threat and for activating the launcher.

8. The fast flyer as claimed in claim 6, characterized by a forward-directed launcher.

9. The fast flyer as claimed in claim 8, wherein the decoy is deployed forwards at an angle to the fast flyer.

10. The decoy as claimed in claim 1, wherein the decoy has an active material container to accommodate an active material.

* * * * *